US005660425A

United States Patent [19]

Weber

[11] Patent Number: 5,660,425

[45] Date of Patent: Aug. 26, 1997

[54] PORTABLE APPARATUS FOR PROVIDING SHELTER ADJACENT A MOTOR VEHICLE

[76] Inventor: Robert S. Weber, 32221 Mill Stream Rd., Trabuco Canyon, Calif. 92679

[21] Appl. No.: 658,556

[22] Filed: Jun. 5, 1996

[51] Int. Cl.[6] ..... B60P 3/34

[52] U.S. Cl. ..... 296/163; 296/161; 135/88.07; 135/88.13; 135/88.01

[58] Field of Search ..... 296/163, 161, 296/159; 135/88.1, 88.3, 88.5, 88.7, 88.13, 88.14

[56] References Cited

U.S. PATENT DOCUMENTS

| | | | |
|---|---|---|---|
| D. 231,443 | 4/1974 | Wayman | D12/156 |
| D. 291,074 | 7/1987 | Ravana | D12/156 |
| 2,788,791 | 4/1957 | Pospisil et al. | 135/88.07 |
| 3,020,919 | 2/1962 | Crump | 135/88.13 |
| 3,186,420 | 6/1965 | Magee | 135/88.07 |
| 3,720,438 | 3/1973 | Johnson et al. | 296/163 X |
| 3,746,386 | 7/1973 | Woodward | 296/23 |
| 3,906,969 | 9/1975 | Myers | 296/161 X |
| 3,923,336 | 12/1975 | Price, Sr. | 296/26 |
| 4,186,758 | 2/1980 | Bridgman | 135/88.1 |
| 4,457,553 | 7/1984 | Larkin | 296/163 X |
| 5,417,469 | 5/1995 | Hammond | 296/163 |
| 5,419,607 | 5/1995 | Oliveira | 296/159 |

*Primary Examiner*—Joseph D. Pape

[57] ABSTRACT

The apparatus includes a collapsible frame assembly having a collapsible main frame assembly and leg mechanism for supporting a portion of the main frame assembly at a desired elevation above the ground. At least one clamp assembly securely attaches the main frame assembly to at least a portion of a motor vehicle. A main cover is supported by the main frame assembly. The cover provides shelter adjacent to the motor vehicle. The use of the collapsible frame assembly which attaches via the clamp assembly to the motor vehicle provides utilization of the motor vehicle's mass and stability to provide structural integrity to the apparatus.

18 Claims, 11 Drawing Sheets

PORTABLE APPARATUS FOR PROVIDING SHELTER ADJACENT A MOTOR VEHICLE

BACKGROUND OF THE INVENTION

1. Field of the Invention

The present invention relates to shelters associated with motor vehicles and more particularly to a collapsible and portable lightweight apparatus for providing shelter adjacent to a motor vehicle.

2. Description of the Related Art

Motorcycle, watercraft, ATV, bicycle and other outdoor sports enthusiasts often require their motor vehicle to become the center of their on-site outdoor activities. In pursuing their activities, there is a need to provide a shelter adjacent their motor vehicle to protect them and/or their equipment from the outdoor elements such as sun and rain.

Others have attempted to solve the problem of providing on-site shelters. For example, U.S. Pat. No. 5,417,469 discloses an apparatus for attaching an enclosure to the back of a motor vehicle which contains a substantially U-shaped plate, at least two devices for attaching such a plate to the motor vehicle, a cover, a device for attaching the cover to the substantially U-shaped plate, and a device for attaching the cover to the motor vehicle.

U.S. Pat. No. 5,419,607 discloses a tenting system for use in association with the bed of a pickup truck. U.S. Pat. No. 3,746,386 discloses a tent for use with automobiles having a rear door which opens upwardly about a horizontal hinge attached to its top edge. The tent has a prism shape including a pair of substantially parallel triangular ends joined on two sides by quadrangles with the third side being open. U.S. Pat. No. DES. 231,443 discloses a pop-up tent for pickup trucks. U.S. Pat. No. DES. 291,074 discloses another ornamental design for a truck tent.

U.S. Pat. No. 3,923,336 discloses a tote-a-room accessory for truck mounted camper units intended to be mounted to the rear of the camper as a permanent part thereof and to open relative to the camper to form an extension rearwardly of the back end of the camper to increase the living area and living capacity of the camper unit.

OBJECTS AND SUMMARY OF THE INVENTION

It is a principal object of the present invention to provide shelter from the outdoor elements at a location adjacent a motor vehicle.

It is another object to utilize the motor vehicle's mass and stability to provide structural integrity to a shelter.

It is yet another object to provide a shelter which is easy to erect, even by a single person.

It is still another object to provide easy ingress and egress of personnel and equipment from the sheltered area.

It is still another object of the present invention to provide an apparatus having a cover which can be adjusted to desired angles to meet various terrain configurations and accommodate various sun angles and efficiently shed rainwater if so desired.

The present invention is a portable apparatus for providing shelter adjacent a motor vehicle. It includes a collapsible frame assembly having a collapsible main frame assembly and leg means for supporting a portion of the main frame assembly at a desired elevation above the ground. At least one clamp assembly securely attaches the main frame assembly to at least a portion of a motor vehicle. A main cover is supported by the main frame assembly. The cover provides shelter adjacent to the motor vehicle.

The use of the collapsible frame assembly which attaches via the clamp assembly to the motor vehicle provides utilization of the motor vehicle's mass and stability to provide structural integrity to the apparatus.

The clamp assembly preferably comprises a C-clamp. Use of such a C-clamp provides easy erection of the apparatus, even by only one person. Special adjustability features provide versatile adjustments to meet various terrain configurations and various environmental needs.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION Of THE PREFERRED EMBODIMENTS

Figure 1:
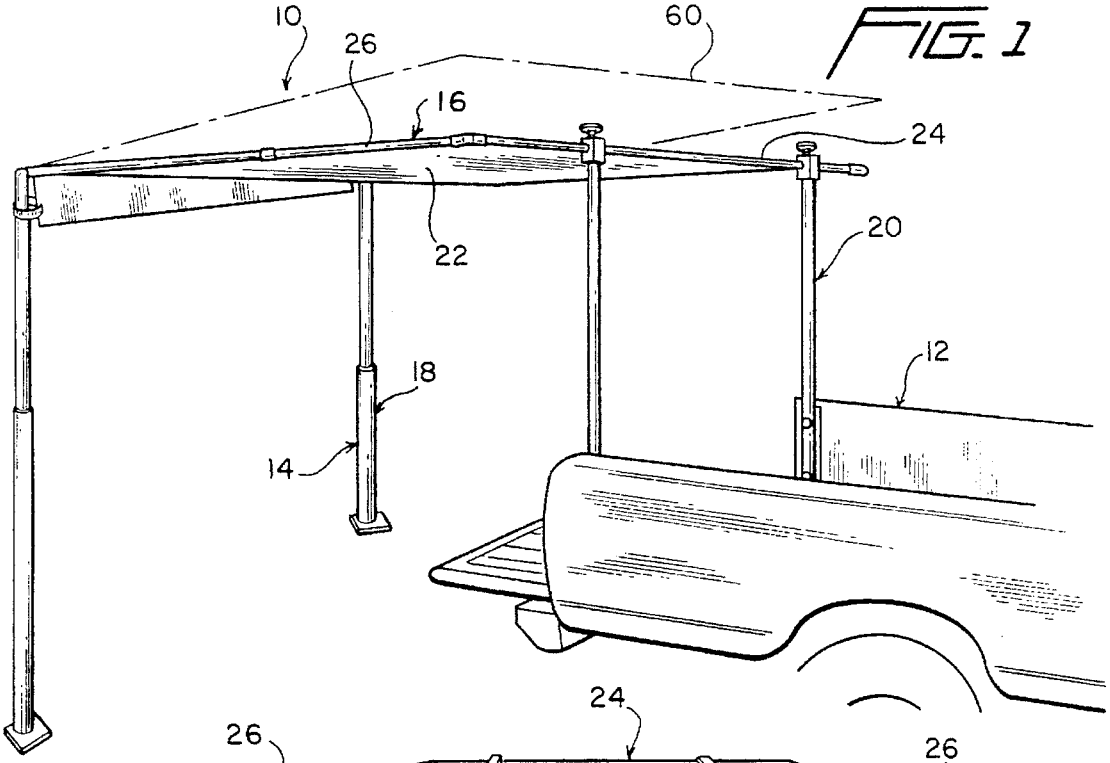
FIG. 1 is a front, left perspective view of a first embodiment of the present invention shown attached to a pickup truck.

Referring now to the drawings and the characters of reference marked thereon FIG. 1, illustrates a first embodiment of the present invention, designated generally as 10, shown attached to a pickup truck 12. Apparatus 10 includes a collapsible frame assembly, designated generally as 14, which includes a collapsible main frame assembly 16 and leg means 18. The leg means support a portion of the main frame assembly 16 at a desired elevation above the ground. A clamp assembly 20 securely attaches the main frame assembly 16 to at least a portion of the motor vehicle 12. A main cover 22, supported by the main frame assembly 16, provides shelter adjacent to motor vehicle 12.

Figure 2:
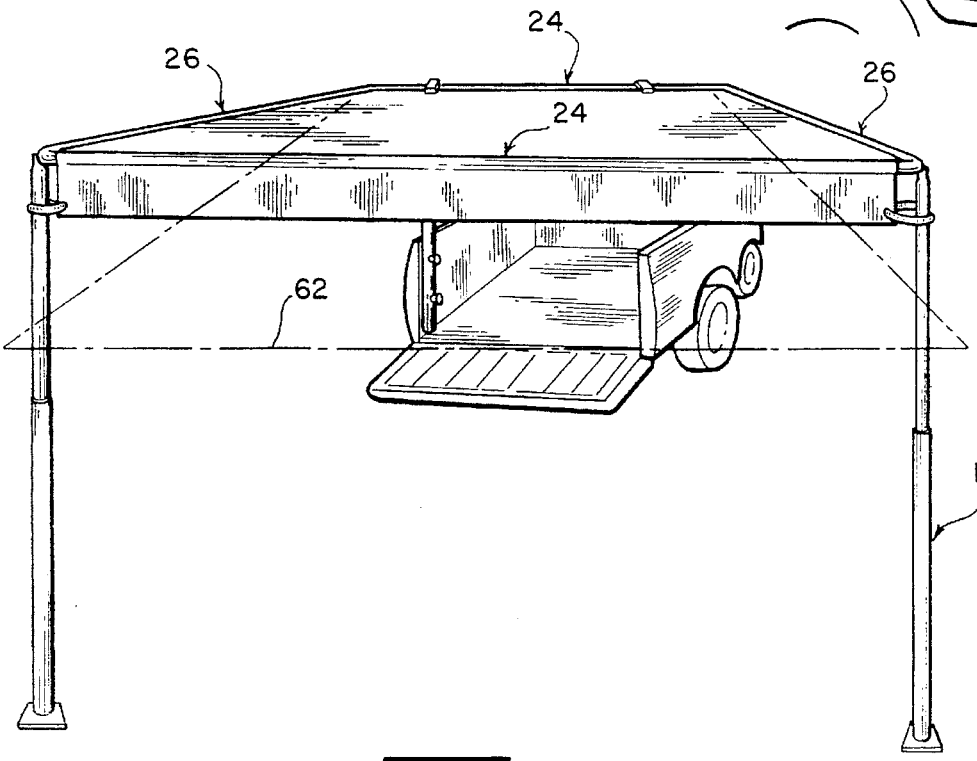
FIG. 2 is a rear perspective view of the apparatus of FIG. 1.

As best seen in FIGS. 1 and 2, the main frame assembly 16 comprises a pair of spaced crossover tube assemblies 24 and a pair of spaced side extension tube assemblies 26. The crossover tube assemblies 24 and side extension tube assemblies 26 are connected so as to form the mainframe assembly 16 having a rectangular shape.

Figure 3A:
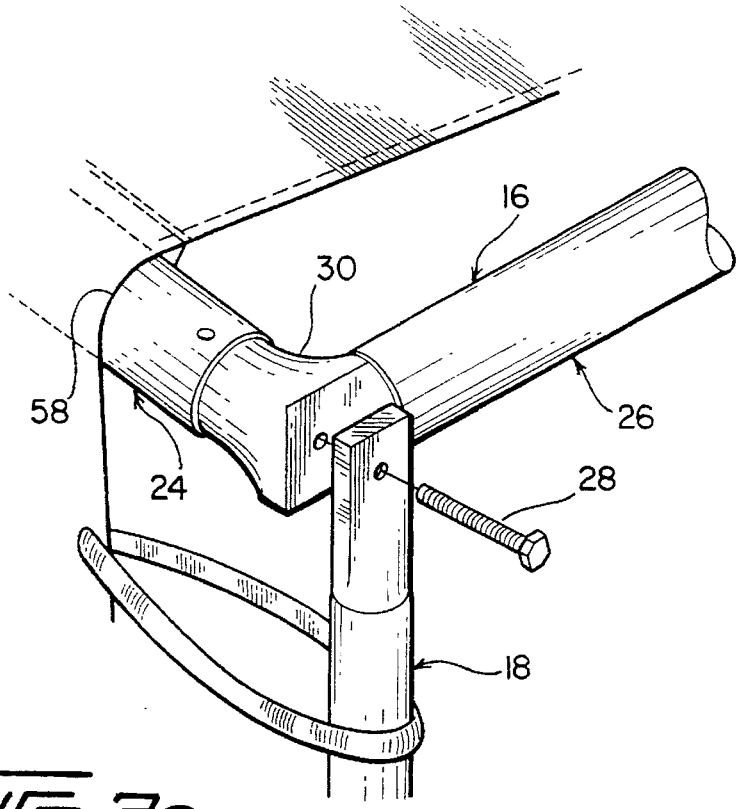
FIG. 3*a* is a perspective view showing connection of a crossover tube assembly with a L-shaped tube connector and extension tube assembly attached to the leg means.

Referring now to FIG. 3*a*, it can be seen how the side extension tube assembly 26 is connected to a crossover tube assembly 24 as well as to a leg means 18. A fastener 28 extends through an opening in the upper end of the leg means 18 and into an L-shaped tube connector 30 to function as a swivel device to provide rotation of the main frame assembly 16 relative to the leg means 18.

Figure 3B:
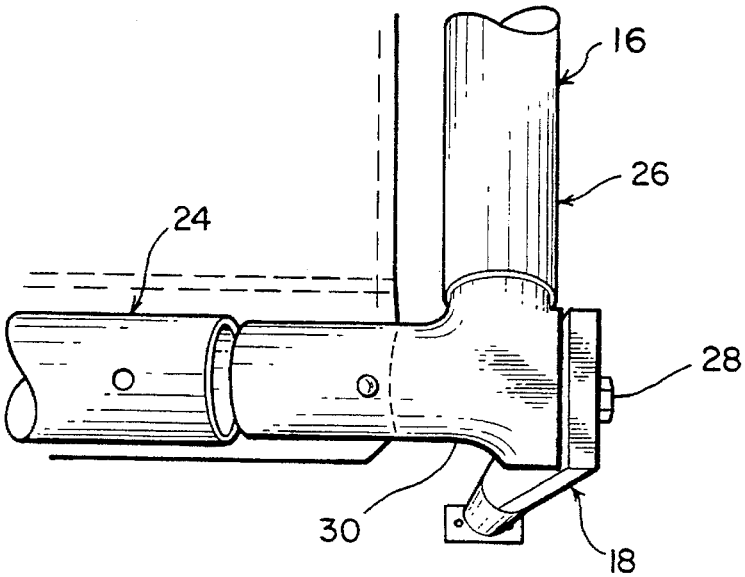
FIG. 3*b* is a top perspective view of the main frame assembly of FIG. 3*a*, showing the leg means connected to the L-shaped tube connector and the crossover tube being disconnected.

In FIG. 3*b*, the fastening member 28 is shown screwed into position to connect the leg means 18 to the main frame assembly 16. The crossover tube assembly 24 is shown extended to reveal how a button-stop mechanism is used to secure the crossover tube assembly 24 to the L-shaped tube connector 30. Such button-stop mechanisms are conventionally used in the tubular frame industry, and typically use a spring loaded locking mechanism (not shown). The side extension tube assembly 26 connects to the L-shaped tube connector 30 by conventional rivet means. Obviously, other methods of attachment may be used such as gluing and/or crimping. Thus, when the apparatus 10 is being stored the side extension tube assembly 26, the L-shaped tube connector 30 and the leg means 18 typically remain collapsible as a subassembly.

Figure 5A:
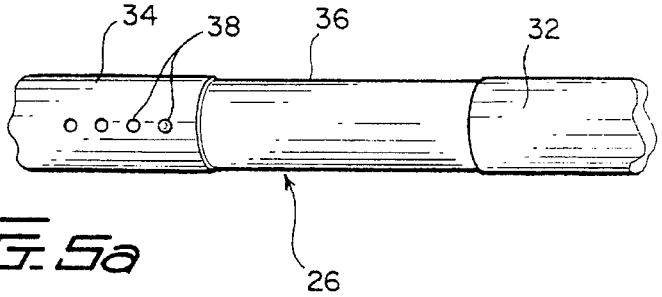
FIG. 5*a* is a perspective view illustrating the sleeve and button-stop mechanism of the side extension tube assembly of the present invention shown in an extended position.
Figure 5B:
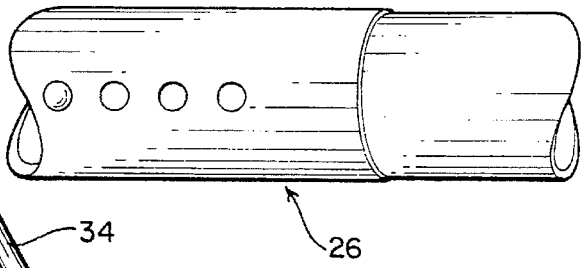
FIG. 5*b* shows the button-stop mechanism in a fully closed position.
Figure 4:
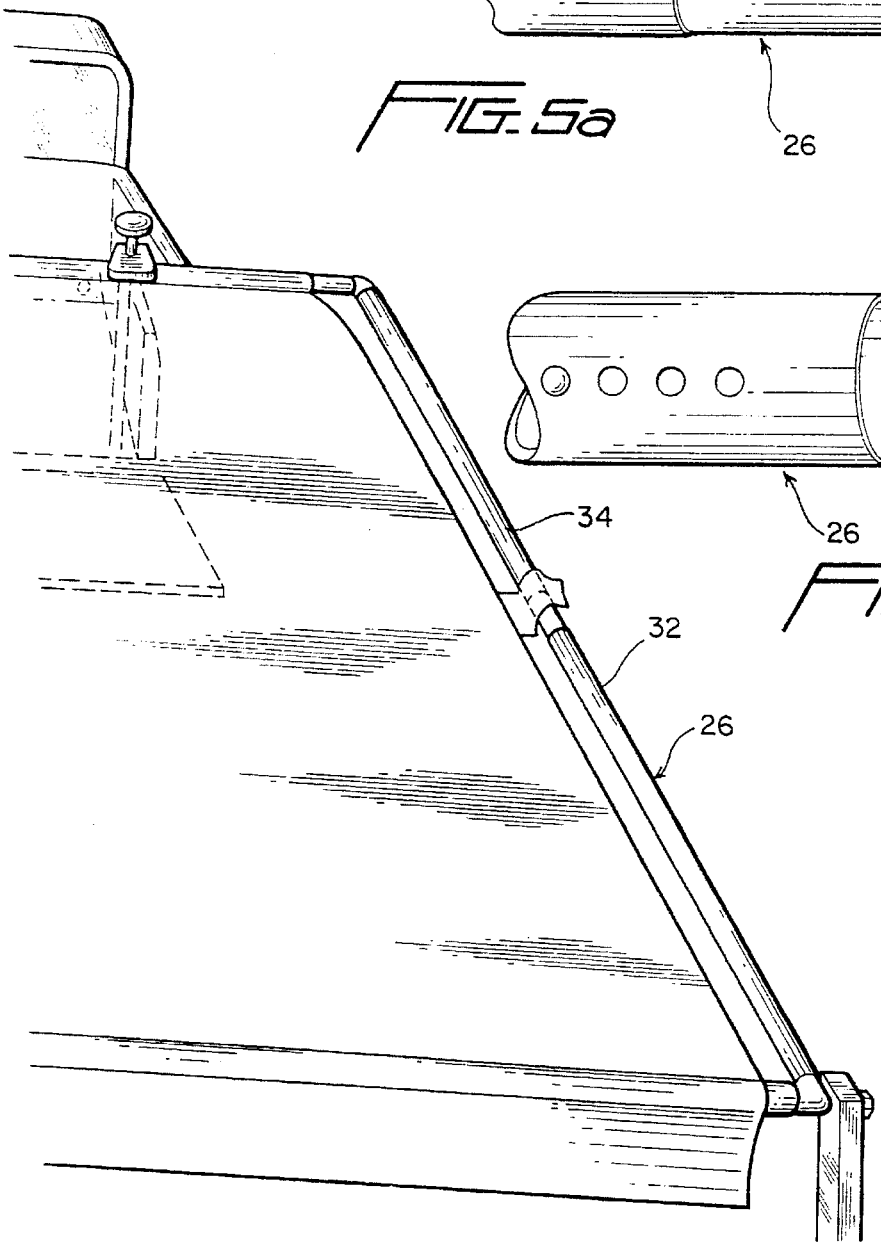
FIG. 4 is a perspective view showing a spaced side extension assembly.

Referring now to FIGS. 4 and 5*a*, a side extension tube assembly 26 is illustrated. Each side extension tube assembly 26 includes a first side extension tube member 32, a second side extension tube member 34, a sleeve 36 firmly affixed to the first side extension tube member 32 and an adjustable button-stop mechanism 38 operably engageable with the sleeve 36 and the second side extension tube member 34 to provide a secure, rigid and adjustable connection between the first side extension tube member 32 and the second side extension tube member 34. The sleeve 36 is affixed to member 32 by gluing, riveting, crimping, or other common manufacturing attachment methods. FIG. 5*b* shows the side extension tube assembly 26 in the fully closed position. Position adjustments compensate for main cover shrinkage or stretching. In either event, the desired tension is provided.

Although the various tube assemblies of the present invention have been described as being telescopic by means of button-stop mechanisms it is understood that other telescoping mechanisms may be used instead. For example, screw-type ring locks and lever cam actuated ring locks, as commonly used as legs with camera tripods, may be used. Other mechanisms may include, for example, twist locking devices.

Figure 6:
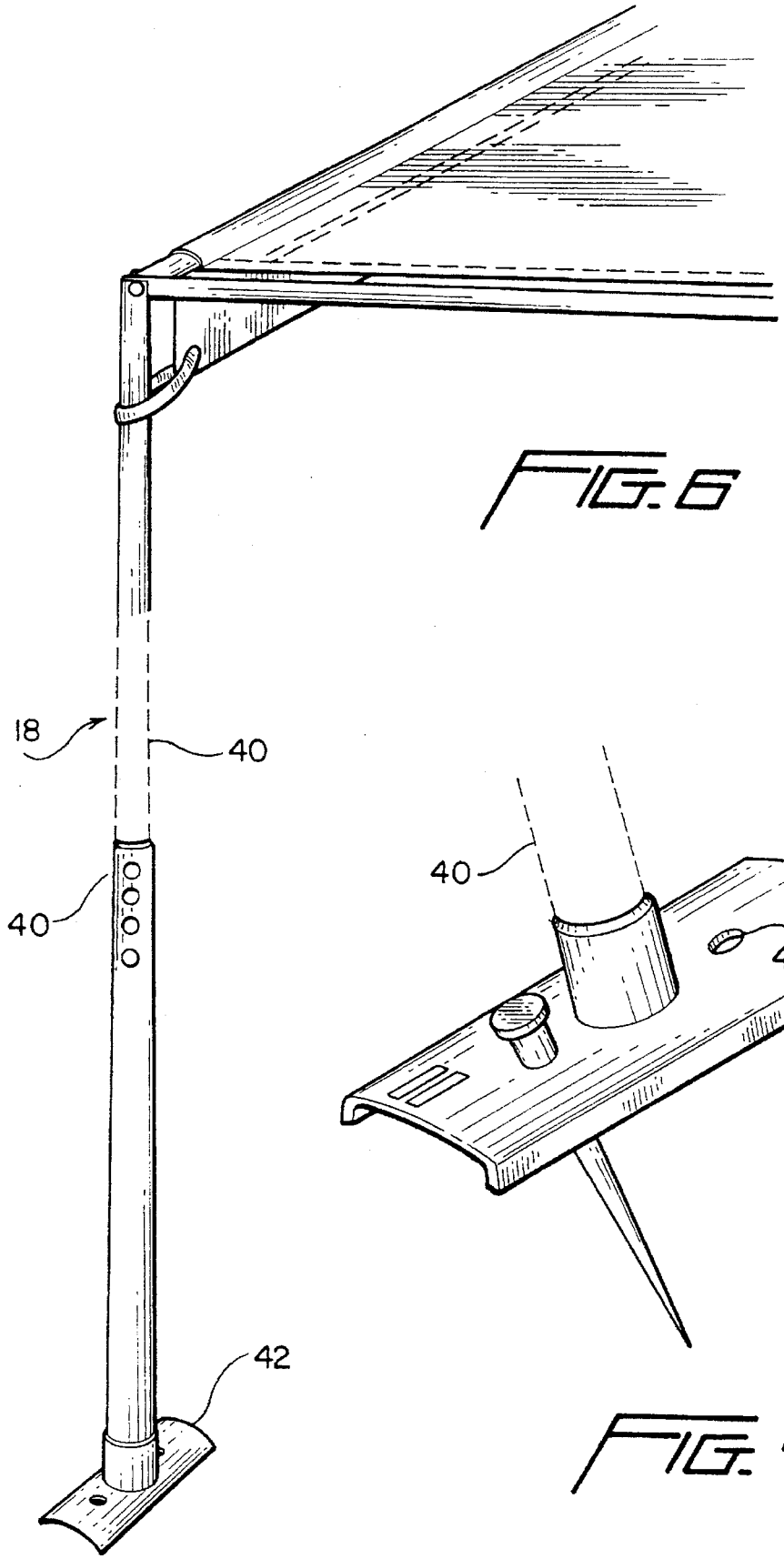
FIG. 6 shows another perspective view of the tubular collapsible legs of the present invention.

Referring now to FIG. 6, a tubular collapsible leg 40 of the leg means 18 is illustrated with an attached support foot 42 at a lower end thereof for adapting to an irregular terrain. The tubular leg 40 includes a button-stop mechanism, as previously described.

Figure 7:
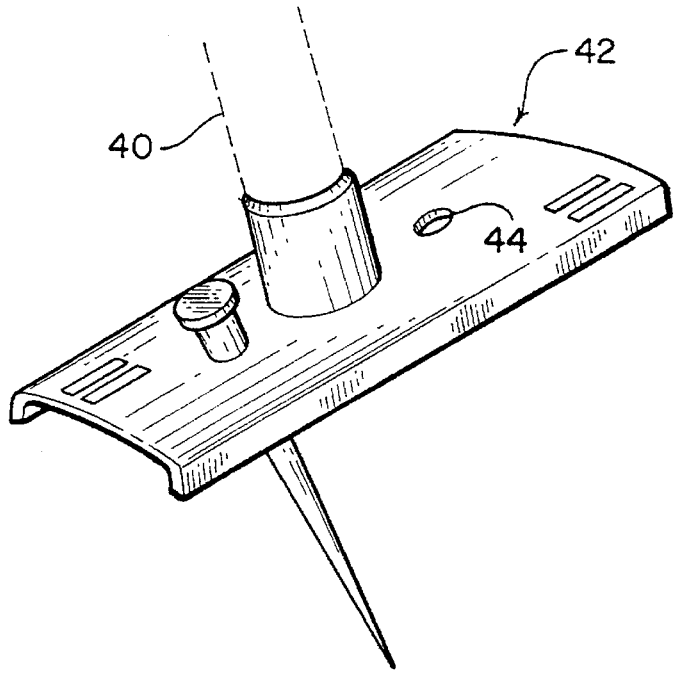
FIG. 7 is a perspective view of the support foot utilized by the present invention.

Referring now to FIG. 7, a support foot 42 is illustrated. The support foot 42 includes holes 44 to allow it to be securely spiked to ground. The foot member 42 is securely fixed to the bottom of the leg 40, preferably by rivets.

Figure 8:
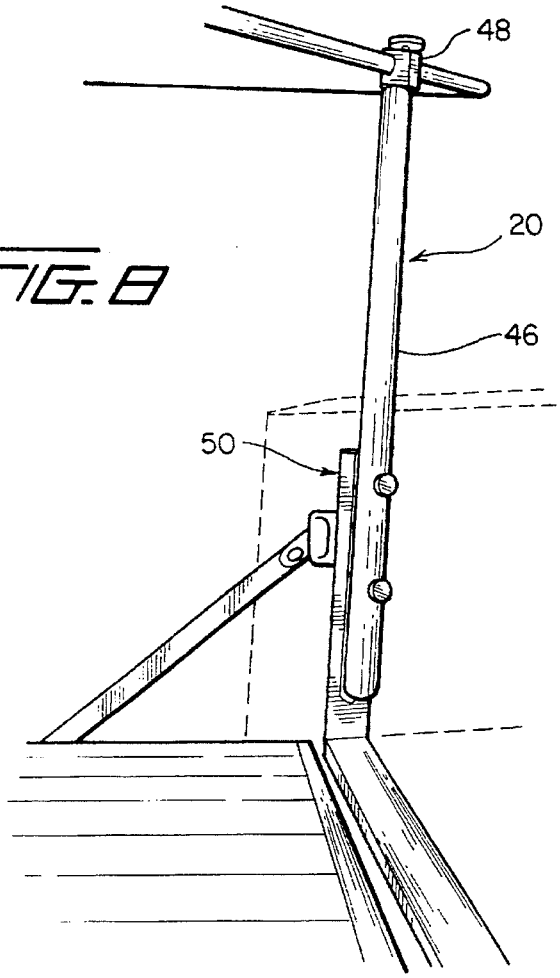
FIG. 8 is a perspective illustration of the clamp assembly of the first embodiment of the present invention.

Referring now to FIG. 8, a clamp assembly 20 is illustrated. Clamp assembly 20 includes a support assembly that includes an elongated tubular support member 46, a C-clamp 48 attached to a first end of the support member 46, and an adjustable base support mount 50 attached to a second end of the support member 46.

Figure 9:
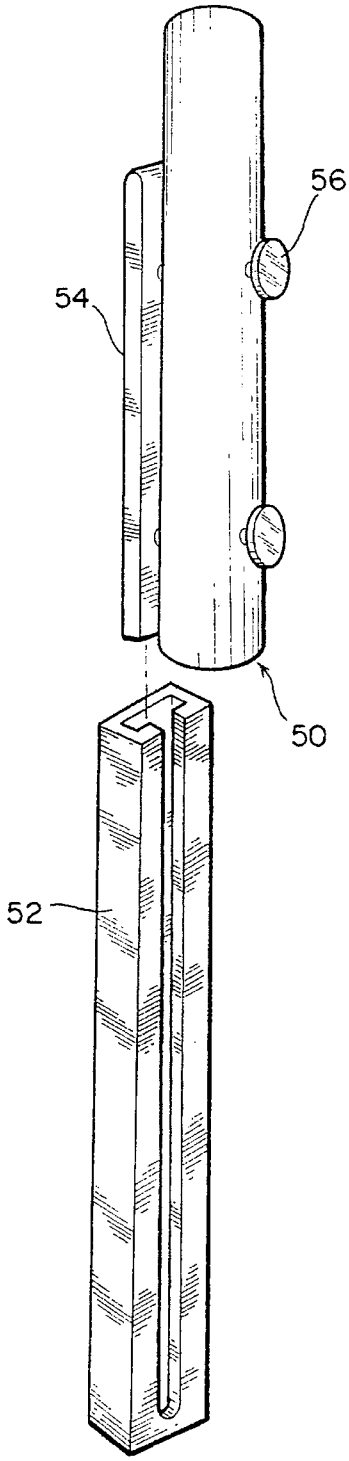
FIG. 9 illustrates the tongue and groove mounting system of the present invention.

Referring now to FIG. 9, the base support mount 50 is shown. Mount 50 includes an adjustable tongue and groove mounting system. The groove portion 52 of the mount 50 is securely fastened to a surface of the open bed of the vehicle.

Figure 10:
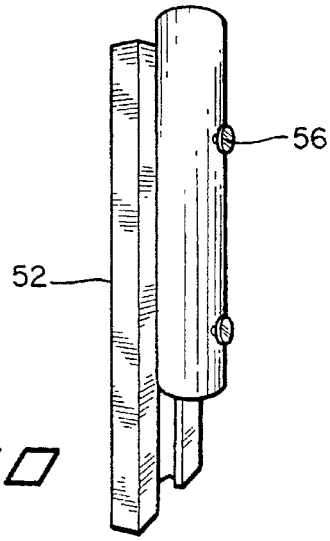
FIG. 10 shows the tongue and groove mounting system in an alternate position.

FIG. 10 shows the tongue portion 54 inserted in the groove channel. Tightening wheels/screw assembly 56 secure the assembly at the desired height.

Figure 11:
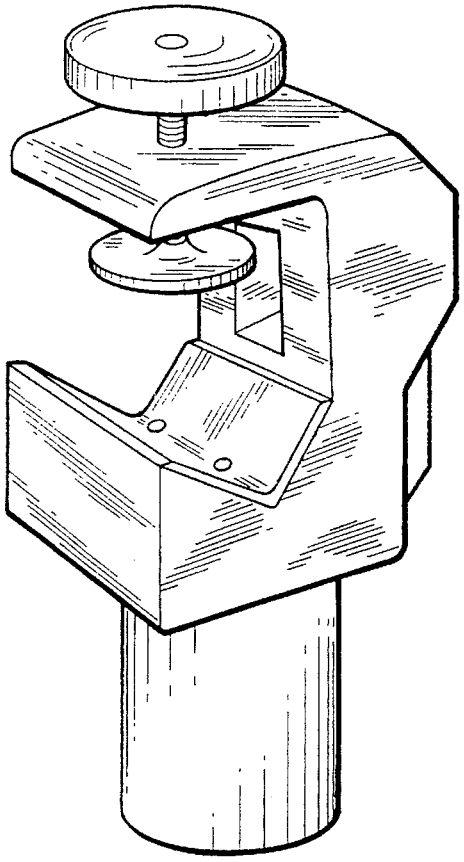
FIG. 11 is a perspective view of a C-clamp preferably utilized as part of the present invention.

Referring now to FIG. 11, a preferred clamp 48 of the clamp assembly 20 is shown. Clamp 48 is a C-clamp. The C-clamp illustrated in FIG. 11 has the ability to adjust from the top. However it is understood that this top adjustability feature is shown by way of illustration and not limitation. Other similarly suited C-clamps may be used with adjustments from the rear, underneath or from the side.

However, although various types of clamp assemblies may be used it is considered a critical aspect of this invention to use a clamp assembly for attaching the apparatus 10 to the vehicle. Use of a clamp assembly allows the user quick and easy mounting of the apparatus to the vehicle.

Figure 12:
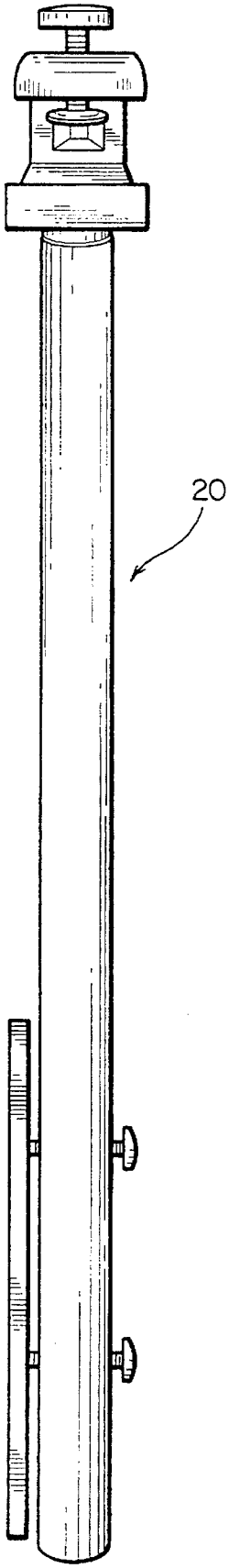
FIG. 12 is an elevational view of the clamp assembly of the present invention.

FIG. 12 shows an elevational view of the clamp assembly 20.

Referring again now to FIG. 1, the main cover 22 is shown supported by the main frame assembly 16. As noted above, it has a substantially rectangular shape. As can be seen in FIG. 3*a*, each end includes a hem sleeve 58 for accepting a respective crossover tube assembly 24. The cover is preferably formed of coated pack cloth. Other suitable materials may be used such as ballistic nylon, rip stop nylon or other nylon polyester blends. The cover should be water-resistant and fire-retardant.

By use of the adjustable leg means 18 and adjustable clamp assembly 20 the elevation and angle of the cover 22 can be adjusted as desired, as shown by phantom lines 60 and 62 in FIGS. 1 and 2, respectively. Such adjustments are particularly useful to compensate for movement of the sun during the day and to shed water off to the desired side during rain.

Figure 13:
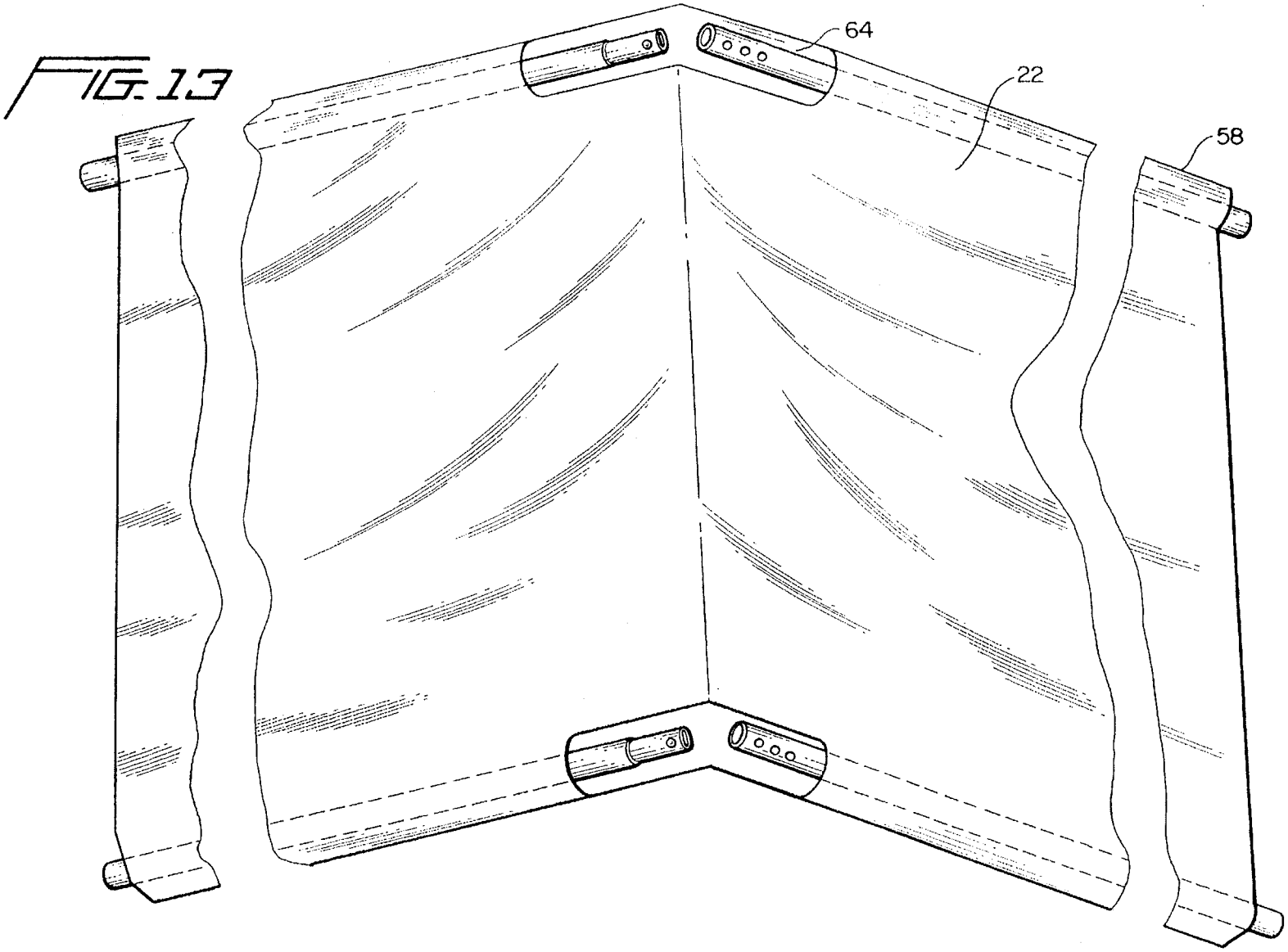
FIG. 13 is a perspective view showing the knockdown perspective of the crossover tubes and main cover for purpose of storage.

Referring now to FIG. 13, it is noted that the cover 22, could be formed with open windows 64 on both ends of the main cover in the hem sleeves 58 to allow easy breakdown and set up of the crossover tube assemblies and cover for ease of set up, breakdown and storage. The windows 64 allow the crossover tube members to be separated or assembled while the cover remains attached to each member.

In use, the apparatus 10 can be entirely stored in an elongated, easy storage tote bag. When desired to be set up, the parts are taken out of the bag and assembled on location. The tubing materials for the main frame assembly are preferably formed of high strength, lightweight aluminum. The clamp assembly is preferably formed of die cast aluminum or high strength plastic composite materials. The foot support is preferably formed of similar die cast aluminum or plastic material.

Figure 14:
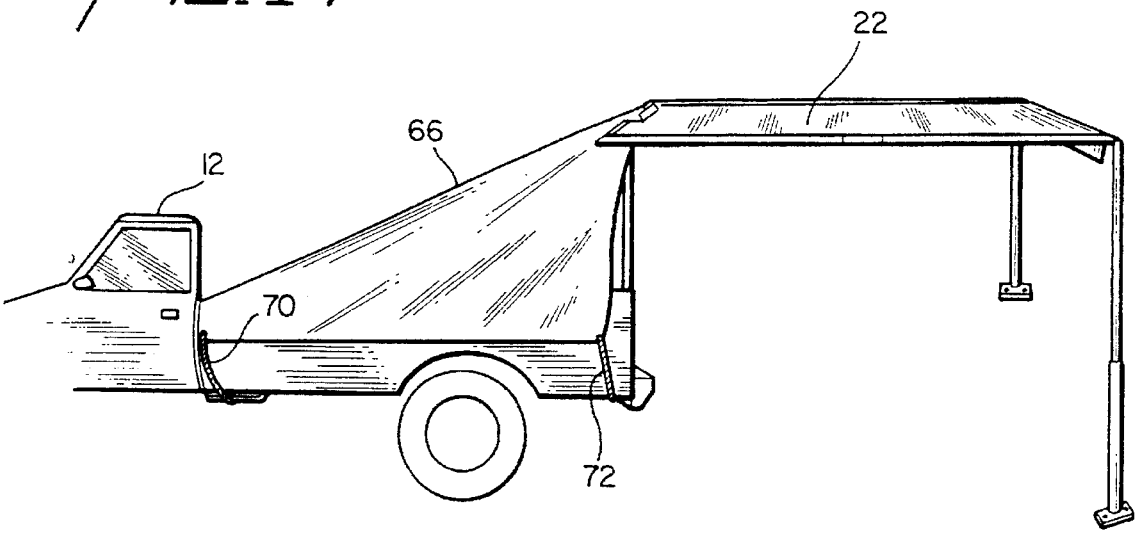
FIG. 14 is a side perspective view of the first embodiment of the present invention, showing utilization of an auxiliary cover assembly.
Figure 15:
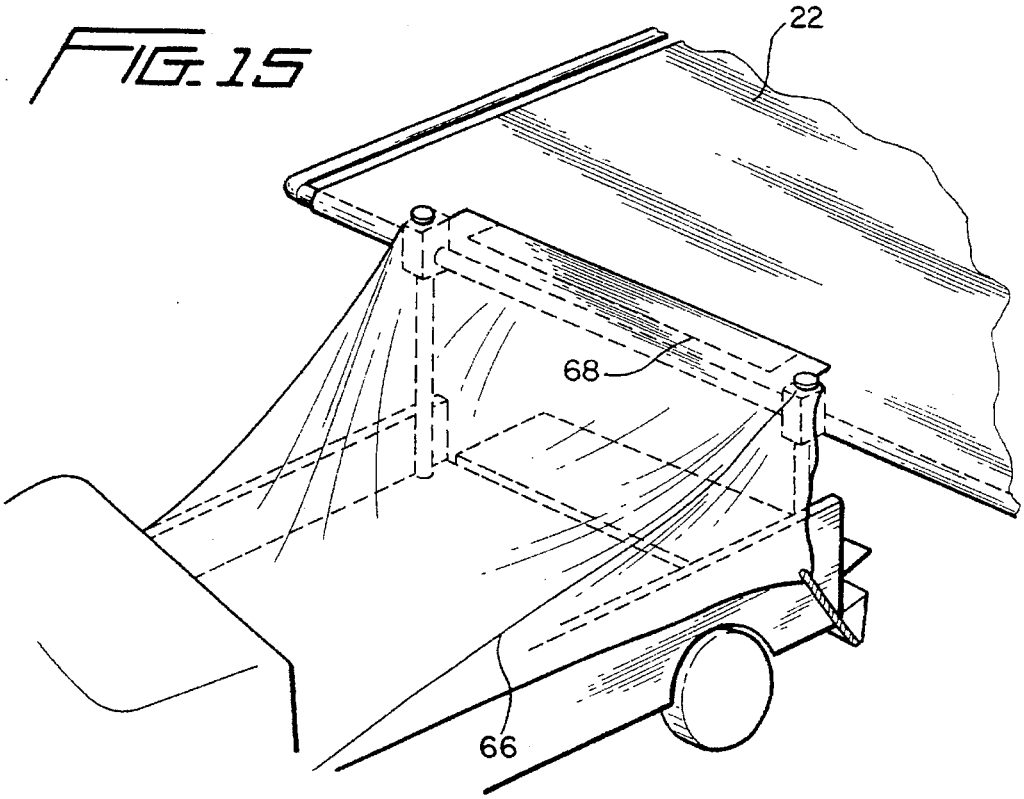
FIG. 15 illustrates attachment of the auxiliary cover to the main cover.

Referring now to FIG. 14, it can be seen that an auxiliary cover assembly 66 is positionable between the motor vehicle 12 and the main cover for providing enhanced sheltering. As can be seen in FIG. 15, the auxiliary cover 66 may be attached to the main cover 22 by VELCRO™, snaps or a zipper, as indicated by phantom lines 68.

Referring again to FIG. 14, it can be seen that the forward end of the auxiliary cover 66 can be attached to the vehicle 12 by use of an adjustable bungee cord 70. Another bungee cord 72 can be used to attach the lower rear portion of the auxiliary cover 66.

Figure 16:
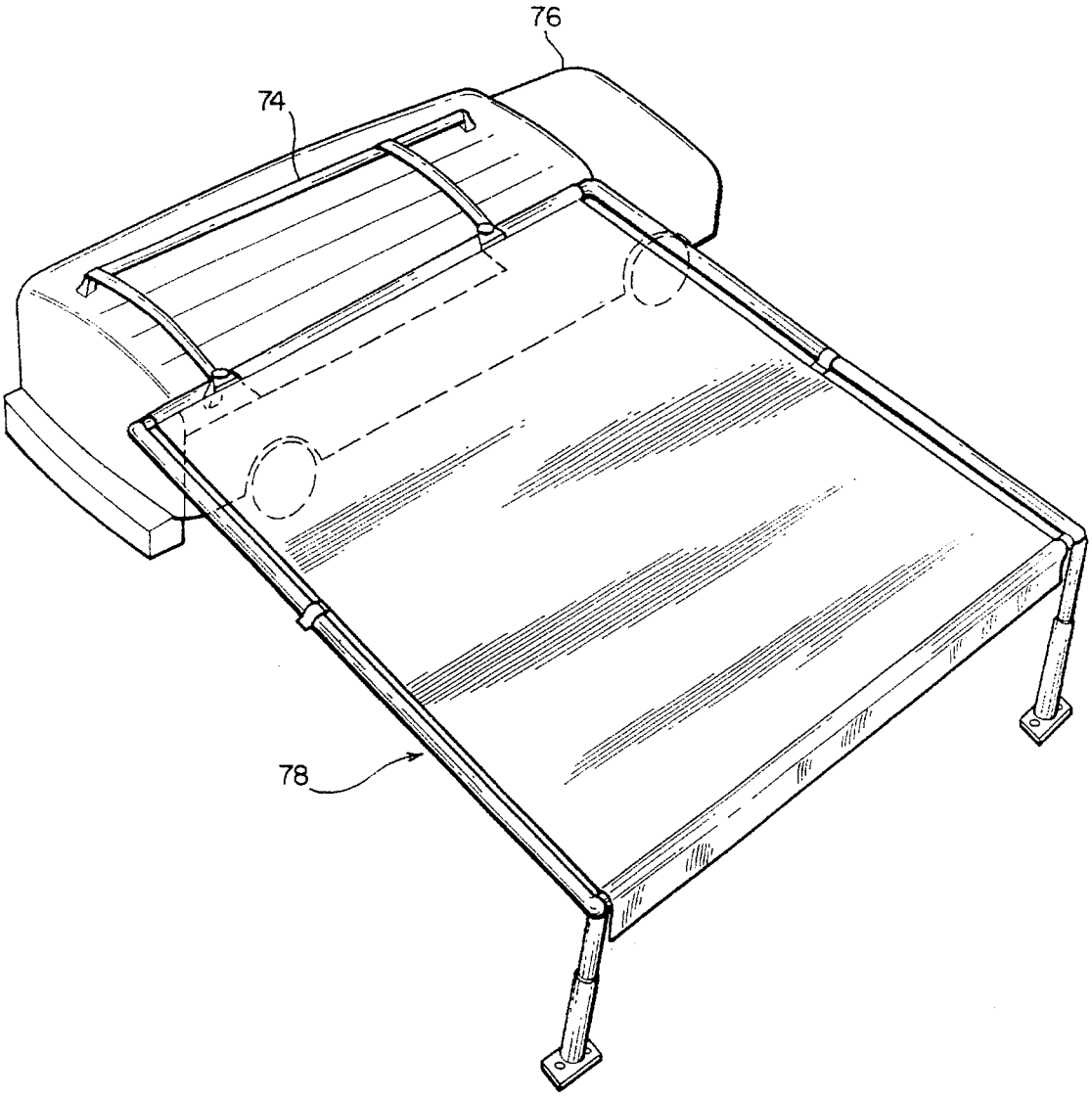
FIG. 16 is a rear, left perspective view of a second embodiment of the present invention shown attached to the roof rack of a vehicle and assembled off to the side thereof.

Referring now to FIG. 16, a second embodiment of the present invention is shown attached to the roof rack 74 of a vehicle 76, this second embodiment being designated generally as 78. Apparatus 78 is similar to the first embodiment; however, it utilizes a different type of clamp assembly.

Figure 17:
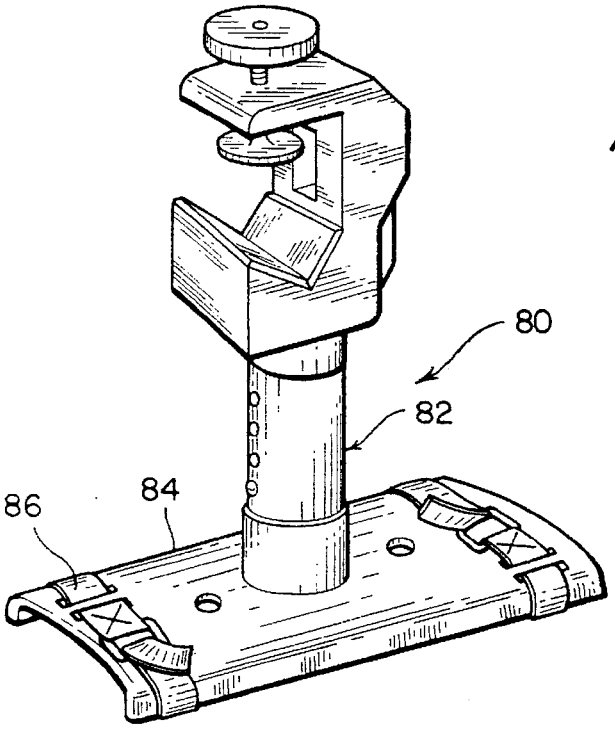
FIG. 17 is a perspective view of a telescoping clamp assembly which may be utilized with the second embodiment of the present invention.

Referring now to FIG. 17, a clamp assembly for use with apparatus 78 is illustrated, designated generally as 80. Clamp assembly 80 includes a support assembly comprising a telescoping button-stop tubular support subassembly 82 and an adjustable base support mount which includes a curved plate member 84 and a mounting strap means 86 for securing the plate member 84 to the roof rack assembly 74 (see FIG. 16).

Figure 18:
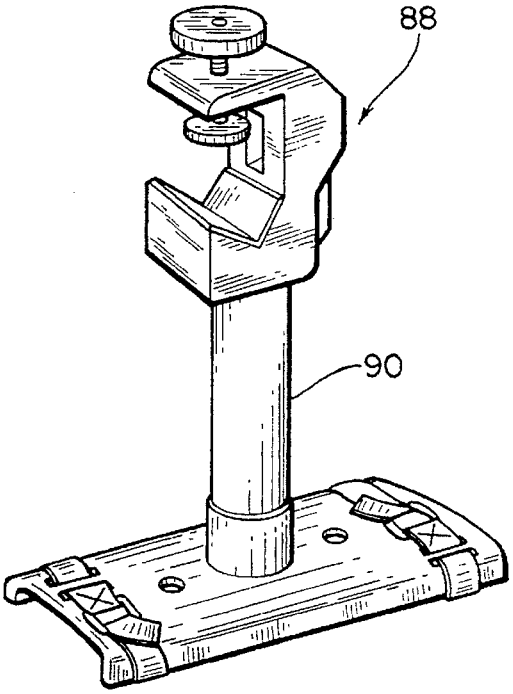
FIG. 18 illustrates a fixed length, clamp assembly which may be utilized with the second embodiment of the present invention.

Referring now to FIG. 18, an alternate clamp assembly 88 is illustrated in which a fixed length tubular support subassembly 90 is used.

Figure 19:
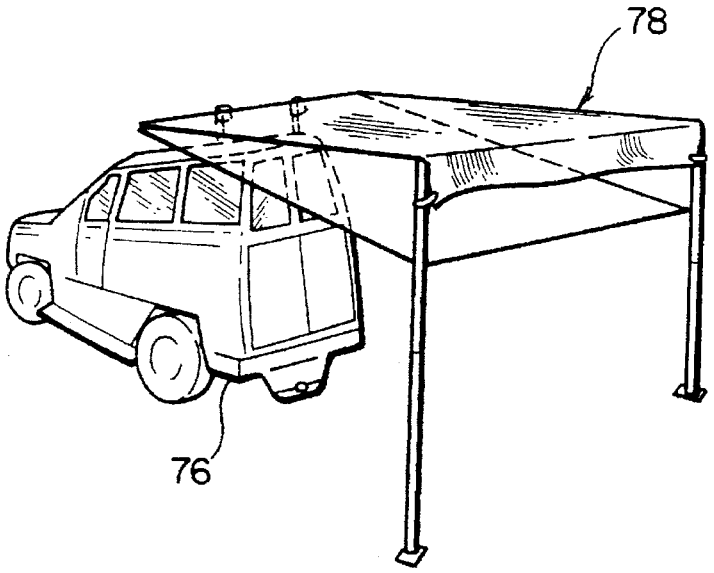
FIG. 19 is a perspective view showing the apparatus of the present invention assembled to the rear of the vehicle.

Referring now to FIG. 19, it can be seen how the apparatus 78 can be utilized off the rear of the vehicle 76 as an optional position.

Figure 20:
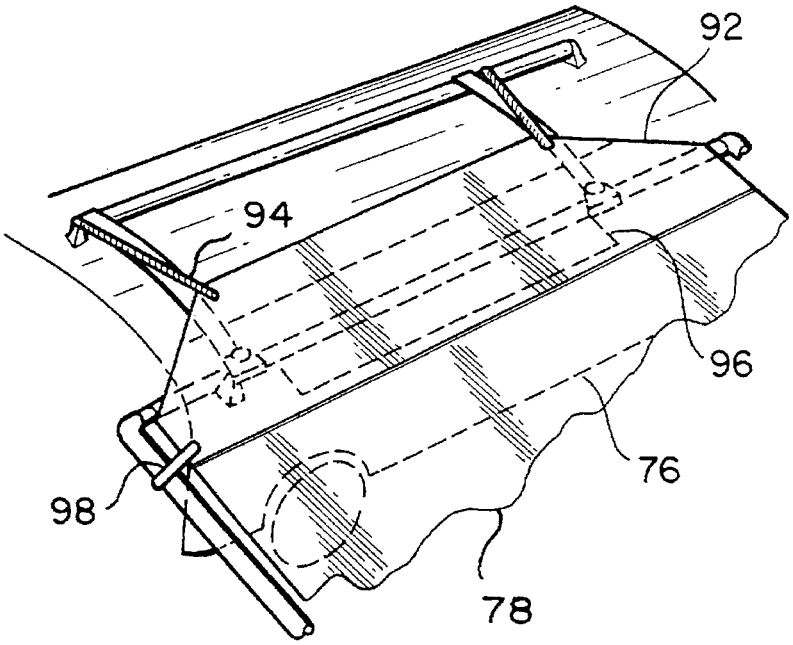
FIG. 20 shows utilization of an auxiliary cover assembly with the second embodiment of the present invention.

Referring now to FIG. 20, an auxiliary cover 92 is illustrated which may be attached to the roof rack via bungee cords 94. The auxiliary cover 92 is attached to the main cover by VELCRO™ fasteners, snaps, or zipper 96 and VELCRO™ straps 98 on each side. Alternatively, they may be sewn together. The auxiliary cover 92 is designed to seal the gap between the apparatus 78 and the roof line of the vehicle 76.

Obviously, many modifications and variations of the present invention are possible in light of the above teachings. For example, the crossover and side extension tube assemblies could alternately be designed to telescope entirely inside themselves in the same manner or design of the leg means, discussed above. The particular design of the L-shaped tube connectors can be altered. For example, they may be formed with rectangular butted ends which mate with the crossover tubes on assembly. In such an example, the butted ends of the side extension tubes, each have an opening which slides over the respective crossover tube which can be tightened down for a secure position. The clamp assemblies could alternately be designed in many different ways such as utilizing a cantilever clamp, or toggle clamp. The auxiliary covers could be designed with various additional features. Examples include windows with netting for ventilation and visibility or a drop curtain to seal in the bed area of the truck in such a manner as to provide a tent-type apparatus. Walls could also be added which enclose the protected area formed by the apparatus. It is, therefore, to be understood that within the scope of the appended claims, the invention may be practiced otherwise than as specifically described.

What is claimed and desired to be secured by Letters Patent of the United States is:

1. A portable apparatus for providing shelter adjacent a motor vehicle, comprising:

a) a collapsible frame assembly, including:

a collapsible main frame assembly, and leg means for supporting a portion of said main frame assembly at a desired elevation above the ground;

b) at least one clamp assembly for securely attaching said main frame assembly to at least a portion of a motor vehicle, said at least one clamp assembly, comprising:

i) a support assembly;

ii) a C-clamp attached to a first end of said support assembly, said C-clamp for providing said secure attachment of said clamp assembly to said main frame assembly; and ii) a base support mount attached to a second end of said support assembly, said base support mount for providing secure attachment of said clamp assembly to the motor vehicle; and c) a main cover supported by said main frame assembly, said cover providing shelter adjacent said motor vehicle.

2. The apparatus of claim 1, wherein said at least one clamp assembly, comprises two clamps.

3. The apparatus of claim 1, wherein each of said at least one clamp assembly is adjustable.

4. The apparatus of claim 3, wherein said motor vehicle comprises a pickup truck having an open bed, each of said at least one clamp assembly, comprising:

said support assembly comprising an elongated tubular support member;

said adjustable base support mount, comprising an adjustable tongue and groove mounting system, a groove portion thereof being securely fastened to a surface of said open bed.

5. The apparatus of claim 3, wherein said motor vehicle includes a roof rack assembly, each of said at least one clamp assembly, comprising:

said support assembly comprising a telescoping, button-stop, tubular support subassembly; and said adjustable base support mount comprising a curved plate member and a mounting strap means for securing said plate member to said roof rack assembly.

6. The apparatus of claim 1, wherein said leg means comprises a plurality of telescoping, button-stop adjustable, tubular legs.

7. The apparatus of claim 6, wherein said tubular legs, each includes a support foot at a lower end thereof for adapting to irregular terrain.

8. The apparatus of claim 1, wherein main frame assembly comprises:

a pair of spaced crossover tube assemblies, and a pair of spaced side extension tube assemblies, said crossover tube assemblies and said side extension tube assemblies being connected so as to form said main frame assembly having a rectangular shape.

9. The apparatus of claim 8, wherein each crossover tube assembly, comprises:

a first crossover tube member;

a second crossover tube member;

a sleeve firmly affixed to said first crossover tube member; and a button-lock mechanism operably engageable with said sleeve and said second crossover tube member to provide a secure and rigid connection between said first crossover tube member and said second crossover tube member.

10. The apparatus of claim 9, wherein said cover has a substantially rectangular shape, two opposing ends thereof including hem sleeves, each hem sleeve for accepting a respective crossover tube assembly.

11. The apparatus of claim 8, wherein each side extension tube assembly comprises:

a first side extension tube member;

a second side extension tube member;

a sleeve firmly affixed to said first side extension tube member; and an adjustable button-stop mechanism operably engageable with said sleeve and said second side extension tube member to provide a secure, rigid and adjustable connection between said first side extension tube member and said second side extension tube member.

12. The apparatus of claim 8, wherein said crossover tube assemblies and said side extension tube assemblies are connected by L-shaped tube connectors.

13. The apparatus of claim 12, wherein the L-shaped tube connectors at the portion of the frame assembly which is supported by said leg means, each comprises a swivel device attached to said leg means for providing rotation of said main frame assembly relative to said leg means.

14. The apparatus of claim 1, further including an auxiliary cover assembly positionable between said motor vehicle and said main cover for providing enhanced sheltering.

15. The apparatus of claim 14, wherein said motor vehicle comprises a pickup truck having an open bed, said auxiliary cover assembly covering said open bed.

16. The apparatus of claim 3, wherein said motor vehicle includes a roof rack assembly, each of said at least one clamp assembly, comprising:

said support assembly comprising a tubular support subassembly; and said adjustable base support mount comprising a curved plate member and a mounting strap means for securing said plate member to said roof rack assembly.

17. A portable apparatus for providing shelter adjacent a motor vehicle, comprising:

a) a collapsible frame assembly, including:

a collapsible main frame assembly comprising:

i) a pair of spaced crossover tube assemblies, each crossover tube assembly, comprising:

a first crossover tube member, a second crossover tube member, a sleeve firmly affixed to said first crossover tube member, and a button-lock mechanism operably engageable with said sleeve and said second crossover tube member to provide a secure and rigid connection between said first crossover tube member and said second crossover tube member, and ii) a pair of spaced side extension tube assemblies, said crossover tube assemblies and said side extension tube assemblies being connected so as to form said main frame assembly having a rectangular shape, and leg means for supporting a portion of said main frame assembly at a desired elevation above the ground;

b) at least one clamp assembly for securely attaching said main frame assembly to at least a portion of a motor vehicle; and c) a main cover supported by said main frame assembly, said cover providing shelter adjacent said motor vehicle.

18. A portable apparatus for providing shelter adjacent a pickup truck having an open bed, comprising:

a) a collapsible frame assembly, including:

a collapsible main frame assembly, and leg means for supporting a portion of said main frame assembly at a desired elevation above the ground;

b) at least one clamp assembly for securely attaching said main frame assembly to at least a portion of a pickup truck;

c) a main cover supported by said main frame assembly, said cover providing shelter adjacent said pickup truck; and d) an auxiliary cover assembly positionable between the pick up truck and said main cover for providing enhanced sheltering, said auxiliary cover assembly covering the open bed.

* * * * *